US005577454A

United States Patent [19]

Goldbach

[11] Patent Number: 5,577,454

[45] Date of Patent: Nov. 26, 1996

[54] TANK VESSEL SUBASSEMBLY FOR EQUIPMENT, PIPING AND OTHER NONSTRUCTURAL COMPONENTS

[75] Inventor: Robert D. Goldbach, Millford, Pa.

[73] Assignees: Metro Machine Corp., Norfolk, Va.; Marinex International, Inc., Hoboken, N.J.

[21] Appl. No.: 592,539

[22] Filed: Jan. 26, 1996

[51] Int. Cl.[6] ..... B63B 3/02

[52] U.S. Cl. ..... 114/65 R; 114/77 R

[58] Field of Search ..... 114/65 R, 72, 114/74 A, 77 R, 78, 222, 83, 85, 88; 29/428, 429

[56] References Cited

U.S. PATENT DOCUMENTS

| | | | |
|---|---|---|---|
| 5,085,161 | 2/1992 | Cuneo et al. . | |
| 5,086,723 | 2/1992 | Goldbach et al. . | |
| 5,090,351 | 2/1992 | Goldbach et al. . | |
| 5,259,332 | 11/1993 | Sekiguchi et al. | 114/65 R |
| 5,269,246 | 12/1993 | Goldbach et al. . | |
| 5,293,830 | 3/1994 | Goldbach . | |
| 5,313,903 | 5/1994 | Goldbach et al. . | |
| 5,320,055 | 6/1994 | Goldbach . | |
| 5,477,797 | 12/1995 | Stuart | 114/65 R |

*Primary Examiner*—Stephen Avila
*Attorney, Agent, or Firm*—Cushman Darby & Cushman, L.L.P.

[57] ABSTRACT

In a modularly constructed longitudinal midbody of a double-hulled tanker, each module is provided, along the vessel centerline, with a prefabricated subassembly including a keel portion of the double hull structure, and a pipe tunnel containing virtually all equipment, piping and nonstructural components required to be installed below the vessel's upper deck to serve the cargo tanks and ballast tanks within the respective module. Each subassembly extends throughout the length of the respective module and respective of its features are connectable at the module ends with the comparable features of adjoining modules. The subassembly may serve as the base for a longitudinal bulkhead.

15 Claims, 2 Drawing Sheets

TANK VESSEL SUBASSEMBLY FOR EQUIPMENT, PIPING AND OTHER NONSTRUCTURAL COMPONENTS

BACKGROUND OF THE INVENTION

The present invention relates to improved double-hull tanker construction, and particularly to construction of such a tanker in which the longitudinal midbody is provided along the centerline of each of its modules, with a respective portion of a keel structure-double hull structure-pipe tunnel subassembly which has been preconfigured with longitudinal and branch cargo and ballast piping, including associated valves and fittings, instrumentation and hydraulic control piping and valves, pipe tunnel ventilation ducts, walkways and other miscellaneous equipment required for routine operation and or maintenance.

The U.S. patent of Cuneo et al., U.S. Pat. No. 5,085,161, issued Feb. 4, 1992, discloses a method and apparatus for constructing a double-hull tanker having a minimum of transverse structure. A series of longitudinal midbody double-hull modules is produced, each in an up-ended orientation which facilitates automated welding of joints at respective sets of proximally arranged plate edges, cleaning and coating of the modules, which are then turned horizontal and serially joined to provide a longitudinal midbody. Prefabricated bow and stern sections are joined to opposite ends of the midbody, and the tanker is completed by installing remaining structural and nonstructural components including piping, valving and wiring. In the Cuneo et al. patent, the vessel hull is shown provided along the centerline of the midbody, with a box-shaped centerline keel structure having its outer and inner sides respectively coincident with the outer and inner hulls of the double-hulled vessel.

The U.S. patent of Goldbach et al., U.S. Pat. No. 5,090,351, issued Feb. 25, 1992, discloses additional details of such a method, apparatus and hull construction, incidentally including a longitudinal bulkhead which divides the cargo space in each module to two side-by-side tanks. In that instance, a structure similar to the box keel structure is illustrated in the same relative location, and forming a base for the longitudinal bulkhead.

Details of construction of the longitudinal bulkhead units of a double-hull tanker, wherein the box keel portions can be fabricated and installed as respective base portions of the longitudinal bulkhead units are disclosed in the U.S. patent of Goldbach et al., U.S. Pat. 5,086,723, issued Feb. 11, 1992.

Various improvements and elaborations upon the mechanical design and construction of such double-hulled tankers and longitudinal midbody modules thereof, are disclosed in Goldbach et al., U.S. Pat. No. 5,269,246, issued Dec. 14, 1993, Goldbach, U.S. Pat. No. 5,320,055, issued Jun. 14, 1994, Goldbach, U.S. Pat. No. 5,293,830, issued Mar. 14, 1994, Goldbach et al., U.S. Pat. No. 5,313,903, issued May 24, 1994, Goldbach copending U.S. patent application No. 08/264,152, filed Jun. 22, 1994, and Goldbach copending U.S. patent application No. 08/281,000, filed Jul. 27, 1994.

Individual cargo and ballast tanks in oil tank vessels are typically outfitted with a considerable amount of equipment, piping and nonstructural components necessary for the safe and efficient carriage and transfer of oil cargos and ballast. In conventional tanker design and construction, this outfit is installed in various structural subassemblies and at various times in the construction schedule.

As a result, some components are installed in the cargo and ballast tanks, making them relatively inaccessible for inspection, maintenance and routine operation. Some may be installed between the hulls, where progressive flooding through piping or through a between-hulls pipe tunnel may adversely impact on survivability of the vessel after bottom damage. Further, incremental installation of these components during construction of the vessel (in contrast to during in-shop-fabrication of subassemblies), leads to variability in layout, inaccessibility of some components, and to damage to surface coatings which gives corrosion early sites to begin attack, and/or to the need for extensive recoating efforts to be expended.

SUMMARY OF THE INVENTION

In a modularly constructed longitudinal midbody of a double-hulled tanker, each module is provided, along the vessel centerline, with a prefabricated subassembly including a keel portion of the double hull structure, and a pipe tunnel above the inner hull and containing virtually all equipment, piping and nonstructural components required to be installed below the vessel's upper deck to serve the cargo tanks and ballast tanks within the respective module. Each subassembly extends throughout the length of the respective module and respective of its features are connectable at the module ends with the comparable features of adjoining modules. The subassembly may serve as the base for a longitudinal bulkhead.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
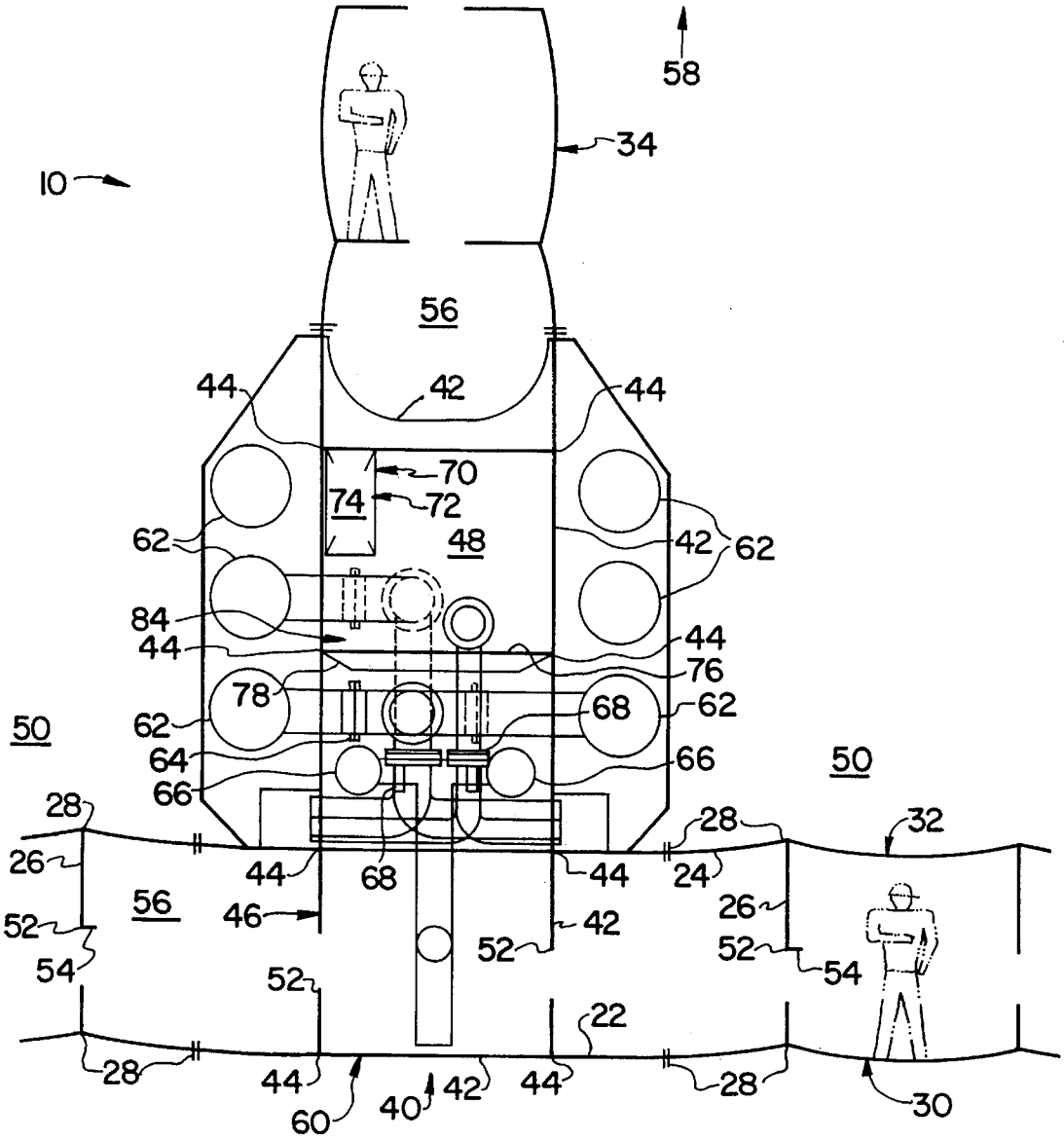
FIG. 1 is a fragmentally vertical transverse cross-sectional view of a vessel midbody module incorporating a prefabricated subassembly of a centerline keel structure and pipe tunnel, with contained equipment, constructed and incorporated in accordance with principles of the present invention.
Figure 2:
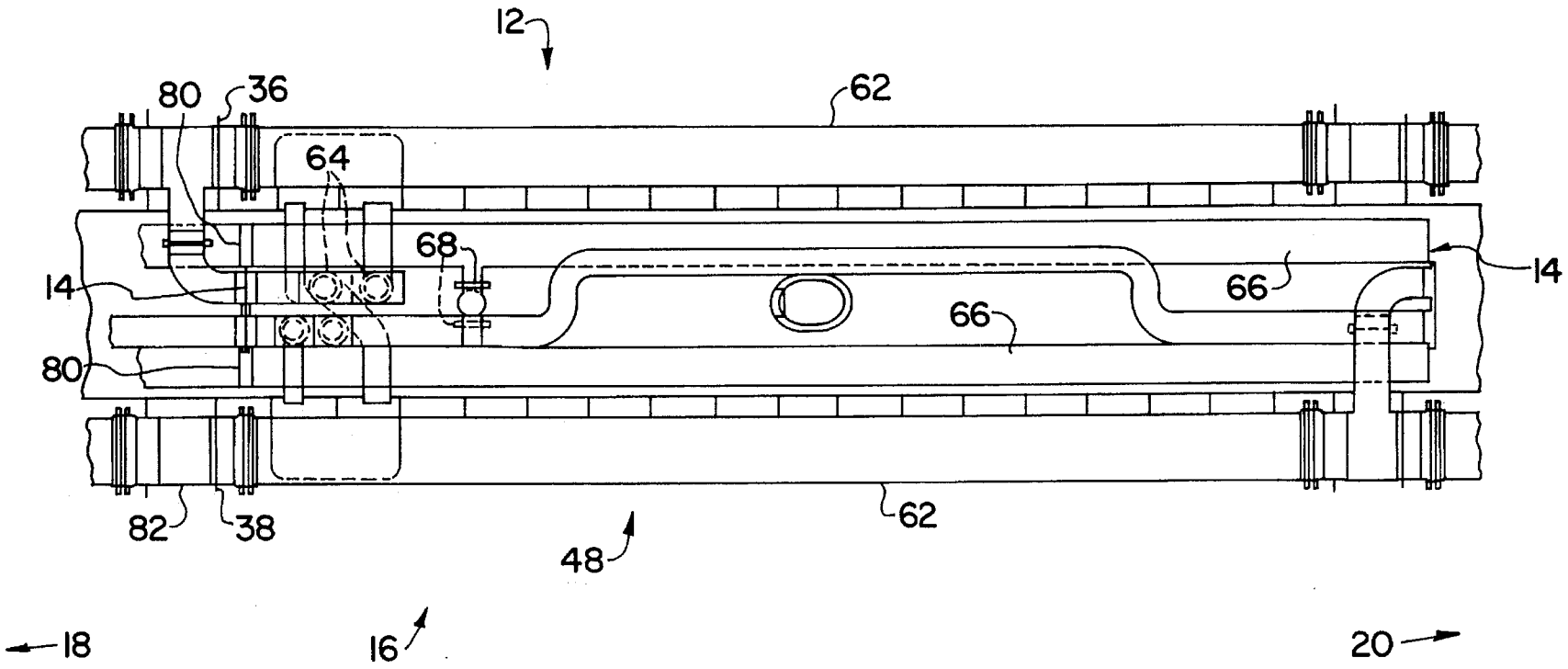
FIG. 2 is a fragmentary, downward-looking horizontal longitudinal cross-sectional view of the structure depicted in FIG. 1, providing emphasis on the equipment tunnel of the subassembly, as incorporated into a module incorporated into midbody of vessel.

FIGS. 1 and 2 are provided so that the locations in a tanker of subassemblies provided in accordance with the principles of the invention will be apparent, despite the fact that, given the small scale of these views, it has been necessary to omit most of the details of those subassemblies.

Depicted in these figures is a double bottomed, most preferably a completely double-hulled, tanker 10, typically for carrying flowable bulk cargo, e.g., a very large crude carrier (a "VLCC"). It has been constructed, preferably in accordance with the principles of the above-discussed U.S. patents and copending U.S. patent applications (except to any extent necessarily constructed otherwise as disclosed in the present description). To that end, a plurality of identical midbody modules 12 are constructed and serially joined at respective ends 14 to form a midbody 16. A bow section 18 is similarly joined to one end of the midbody, and a stern section 20 is similarly joined to the opposite end of the midbody. (In fact, among them, the above-discussed U.S. patents and copending U.S. patent applications disclose a variation in which a forward-half midbody is constructed and a bow section joined to one end of it, a rear-half midbody is constructed and a stern section joined to it, whereupon the free ends of the two half midbodies are then joined to constitute the vessel. That alternative is intended to be included in definitions of construction of the vessel as provided herein.)

As illustrated among the drawing figures of the above-mentioned U.S. patents and copending U.S. patent applications, each midbody module 12 of the vessel 10 preferably is fabricated of steel plate 22, 24, 26 in module subassemblies, by electrogas or electrogas welding, while the plates are held in respective vertical planes, in jigs or fixtures, with longitudinal edges of plates which are to be joined maintained in closely spaced juxtaposition. Each plate extends from end to end of the respective module. In effect, each longitudinal welded joint 28 is formed as a continuous casting of weld metal confined by plate edges and cooled backing rods as the welding apparatus moves vertically upwards at the site of the joint being formed. In this manner, each module subassembly comes to include a respective portion of the outer hull 30, a respective portion of the inner hull 32, a plurality of hull-interconnecting spacer plates 26 which are spaced from one another girthwise of the vessel and have their opposite longitudinal edges incorporated in the respective joints 28 of the outer and inner hull portions.

If the vessel is to include longitudinal bulkheads 34 (e.g., to divide the cargo space into transversely spaced cargo tanks), the increments of these for the respective modules can each be constructed in the same manner as a module subassembly.

Transverse bulkheads 36 (which can either be blind, in order to divide the cargo space into longitudinally spaced cargo tanks or centrally ported so as to intercommunicate spaces of two or more longitudinally serially adjoining modules) are separately fabricated.

Each module 12 is then fabricated by assembling a set of module subassemblies in an up-ended condition, around the perimeter of a horizontally disposed transverse bulkhead, and welding the adjoining longitudinal edges of respective subassemblies to one another (e.g., by electrogas or electroslag welding as described above), and all of the module subassemblies to respective segments of the perimeter of the transverse bulkhead 36, thereby creating an up-ended module having a transverse bulkhead at its lower end, its upper end being open.

In the instance where the modules are intended to include longitudinal bulkheads 34, the respective transverse bulkheads 36 are provided in two complementary, mirror image portions 38, which sandwich one end of the longitudinal bulkhead 34 medially between them and are welded to corresponding plate margins of both.

A prefabricated bottom centerline subassembly 40 provided in accordance with the principles of the present invention preferably is incorporated into each module 12 at the stage which has just been described, i.e., as the module wall subassemblies are being joined to one another and to a transverse bulkhead and, if provided, to a longitudinal bulkhead.

For convenience in module fabrication, a subassembly 40 can be preliminarily joined along its longitudinal extent to another part along the longitudinal extent of that part, e.g., to a longitudinal bulkhead 34 thereby forming a base of the longitudinal bulkhead, or to the longitudinal edges of the inner and outer hull plates of one of the double hull wall subassemblies. Alternatively, the subassembly 40 can be joined to the other prefabricated parts to which it must be welded, at the same time or within the same time interval that all of the other prefabricated parts are being welded together to create a module.

Each subassembly 40 is defined in part by a plurality of rectangular steel plates 42 joined to one another along adjoining longitudinal edges to provide joints 44. Fabrication techniques used can be conventional welding, or automated welding of the plates while held upended in a jig or fixture, in the same manner that the hull wall module subassemblies are fabricated, as described above. Accordingly, each subassembly 40 includes a box keel portion 46 (which comes to form a respective longitudinal medial portion of the double hull of the vessel, and along its upper side, so as to be above (externally bounded by) the inner hull 32, a pipe tunnel portion 48.

The larger scale ones of the drawing figures illustrate the preferred thicknesses of the plates 42 of the prefabricated subassemblies 40 of the present invention, relative to the preferred thicknesses of the hull face plates, spacer plates, and bulkhead plates.

In a usual layout of the vessel 10, there are a plurality of separate cargo tanks 50 separated by transverse bulkheads 36, each being at least as long as one module (depending on whether the bulkheads 36 are blind or ported), and each being arranged in side-by-side relationship with at least one other, separated by a respective longitudinal bulkhead 34, if provided. (In other layouts, no longitudinal bulkhead is provided and so each module contains at most one tank, which extends from sidewall to sidewall of the inner hull of that module.)

By preference, the interhull spacer plates 26 are ported by so-called lightning holes 52 (or at least some of them are) and stiffened by welded-on kick plates 54, so that the interhull confined space of each module 12 provides at least one respective ballast tank 56, or a portion thereof. If the ballast tank structure is longitudinally delimited, e.g., at module ends, to separate the space into several serially longitudinally adjoining ballast tanks, the separating walls may be provided by respective outer perimetrical flange portions of the respective transverse bulkheads 36.

It should be apparent that the constructional details of a vessel 10 necessarily include means for introducing flowable bulk cargo (e.g., crude oil) into the cargo tanks 50, and for withdrawing the cargo from the cargo tanks, as well as means for introducing ballast (e.g., water) into the ballast tanks 56, and for withdrawing the ballast from the ballast tanks. To a certain extent, it is convenient to provide the necessary piping, valving and associated structure of such means upon and penetrating through the deck 58 of the vessel 10. That is true both of the prior art and of preferred practices of the present invention.

In the prior art, the remainder of such piping, valving and associated structure is variously provided, some in the interhull space, some in the cargo tanks, and some within the box keel. It is customary practice to install this piping, valving and associated structure as the vessel is being outfitted, e.g., after its bottom, sidewalls, deck and bulkheads have been joined. The same is true of some other equipment which may be associated with operating, inspecting, filling and emptying the vessel, e.g., instrumentation, hydraulic control piping, ventilating ductwork, walkways, fittings, supports and coupling parts.

By preference, to the maximum extent possible, for each module 12, all of the apparatus is, according to the principles of the present invention preinstalled, under shop conditions, into the welded plate shell 60 of the respective subassembly 40.

In the preferred embodiment, these structures are shown including cargo suction and/or discharge piping 62, and associated fittings, valves and coupling parts 64, ballast suction and/or discharge piping 66, and associated fittings, valves and coupling parts 68, instrumentation 70, hydraulic control piping 72, ventilation ductwork 74, walkways 76, supports 78, and coupling ends 80 (for use with connectors 82 for joining piping at module-to-module transitions).

Auxiliary portions of the above-identified structures 62–80, which necessarily penetrate the shell 60 and extend to or from the vessel outside the shell 60 in the completed vessel 10 are indicated by respective ones of the numerals 62–80, suffixed by the letter A, e.g., 62A.

Although in certain cases, everything that will be installed in each shell (but for the intermodule connectors 82 of respective portions of structures 62–80), in many cases at least some structures, typified by electrical wiring 84 preferably or necessarily is installed after the modules 12 are joined to create the longitudinal midbody 16, or after the bow and stern sections 18, 20 are joined to the midbody 16 to create the vessel 10.

While longitudinally configured cargo piping not requiring the installation of valves may be located outside the pipe tunnel, all equipment requiring routine operation and/or maintenance is located inside the pipe tunnel.

Several benefits derive from the construction of a double hull tanker and the modules and midbody thereof in accordance with the principles of the present invention, including:

A. Since for a given double hull tanker, each module is virtually identical, a standardized subassembly 40 can be mass-produced very precisely and economically and simply welded to adjoining structural (hull) subassemblies during construction of each module. As modules are joined to each other by welding, longitudinally configured piping is easily joined, preferably without welding by devices known as Dresser couplings 80, 82. Significant economies are realized by installing all equipment, piping and nonstructural components early in the construction process under controlled shop conditions.

B. By installing all midbody equipment, for each module, piping and nonstructural components in a single subassembly at the subassembly stage of the construction process rather than later in the construction process, expensive rework (including recoating) in areas affected by such later installation is avoided with favorable effect on product quality and cost.

C. By installing in a pipe tunnel 48 all components of equipment requiring routine operation or maintenance, rather than in cargo or ballast tanks, accessibility to these components is greatly improved and tanker operation is safer, easier and more economical.

D. By installing in a pipe tunnel 48, all longitudinally configured cargo and ballast piping and all valves and equipment above the inner hull 32, survivability of the vessel after bottom damage is greatly improved by minimizing potential for progressive flooding either through piping or through the pipe tunnel.

It should now be apparent that the tank vessel subassembly for equipment, piping and other nonstructural components as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for constructing at least one midbody module for a double-hulled tanker having at least one cargo tank and at least one interhull space for receiving liquid ballast, comprising:

(a) providing a shell including a box keel increment which is longitudinally coextensive with and connected along the length thereof to a pipe tunnel increment;

(b) installing outfitting equipment in said pipe tunnel increment, including valved longitudinal piping for serving at least one cargo tank and at least one interhull space, for providing a prefabricated bottom centerline subassembly having a longitudinal direction;

(c) providing a transverse bulkhead having a perimeter including two opposed portions corresponding in location to vessel sidewalls, a first intervening portion corresponding in location to a vessel bottom, and a second intervening portion opposed to said first intervening portion and corresponding in location to a vessel deck, said first intervening portion having a medial site;

(d) providing a plurality of midbody module hull subassemblies, at least some of which are double-hulled, so as to include an outer hull increment having a longitudinal direction, and an inner hull increment having a longitudinal direction and being secured in spaced, facially confronting relation to the respective said inner hull increment, with respective longitudinal directions aligned, by a plurality of longitudinally extending spacer plates, spaced from one another girthwise of said midbody module, and connected along an inner extent thereof to said inner hull increment and along an outer extent thereof to said outer hull increment;

(e) assembling said midbody module hull subassemblies and said prefabricated bottom centerline subassembly about said perimeter of said transverse bulkhead with all of said longitudinal directions parallel to one another, with said prefabricated bottom centerline subassembly centered on said medial site and flanked by double-hulled ones of said midbody module hull subassemblies, with said pipe tunnel increment oriented inwards; and (f) securing respective ones of said subassemblies which adjoin one another girthwise of said midbody module, along corresponding longitudinal extents thereof, to one another, and all of said subassemblies to said transverse bulkhead, thereby uniting said subassemblies and said transverse bulkhead to provide said midbody module.

2. The method of claim 1, wherein:

said box keel increment is at least as lineally extensive in a height direction of said midbody module, as are said double-hulled ones of said midbody hull subassemblies flanking said prefabricated bottom centerline subassembly, so that said pipe tunnel increment is disposed wholly within an inner hull collectively defined by said inner hull increments and said box keel.

3. The method of claim 1, wherein:

as steps (e) and (f) are being carried out, said transverse bulkhead is arranged horizontally and said longitudinal directions of said subassemblies extend vertically.

4. The method of claim 1, further including:

as part of step (c), providing said transverse bulkhead as two laterally spaced complementary increments;

prior to conducting step (e), providing a longitudinal bulkhead which includes two laterally opposite wall increments secured in spaced, facially confronting relation with respective longitudinal directions aligned, by a plurality of longitudinally extending spacer plates, spaced from one another vertically of said midbody module, and connected along one lateral extent thereof to one of said wall increments and along an opposite lateral extent thereof to the other of said wall increments; and sandwiching said longitudinal bulkhead between said increments of said transverse bulkhead and securing said increments of said transverse bulkhead to said longitudinal bulkhead, so that as step (e) is conducted, said longitudinal bulkhead becomes incorporated into said midbody module.

5. The method of claim 4, wherein:

said longitudinal bulkhead is secured along a base thereof to an upper side of said pipe tunnel increment.

6. The method of claim 5, wherein:

said box keel increment is at least as lineally extensive in a height direction of said midbody module, as are said double-hulled ones of said midbody hull subassemblies flanking said prefabricated bottom centerline subassembly, so that said pipe tunnel increment is disposed wholly within an inner hull collectively defined by said inner hull increments and said box keel.

7. The method of claim 1, wherein:

said outfitting equipment installed in step (b) further includes at least one of: instrumentation, hydraulic control piping, ventilation ducting and a walkway.

8. The method of claim 1, further including:

(g) repeating steps (a)–(f) and thereby constructing a second and a third said midbody module;

(h) serially arranging said second, the first-described, and said third midbody modules in horizontal, axially aligned orientation, end to end; and (i) connecting respective adjacent portions of respective ones of said modules to one another for thereby providing at least a multiple-module portion of a longitudinal midbody for a vessel, this including coupling respective ends of respective pipes of said longitudinal piping.

9. A midbody module for a double-hulled tanker having at least one cargo tank and at least one interhull space for receiving liquid ballast, comprising:

(a) shell including a box keel increment which is longitudinally coextensive with and connected along the length thereof to a pipe tunnel increment;

(b) outfitting equipment installed in said pipe tunnel increment, including valved longitudinal piping for serving at least one cargo tank and at least one interhull space, and thereby providing a prefabricated bottom centerline subassembly having a longitudinal direction;

(c) a transverse bulkhead having a perimeter including two opposed portions corresponding in location to vessel sidewalls, a first intervening portion corresponding in location to a vessel bottom, and a second intervening portion opposed to said first intervening portion and corresponding in location to a vessel deck, said first intervening portion having a medial site;

(d) a plurality of midbody module hull subassemblies, at least some of which are double-hulled, so as to include an outer hull increment having a longitudinal direction and an inner hull increment having a longitudinal direction and being secured in spaced, facially confronting relation to the respective said inner hull increment, with respective longitudinal directions aligned, by a plurality of longitudinally extending spacer plates, spaced from one another girthwise of said midbody module, and connected along an inner extent thereof to said inner hull increment and along an outer extent thereof to said outer hull increment;

(e) said midbody module hull subassemblies and said prefabricated bottom centerline subassembly being assembled about said perimeter of said transverse bulkhead with all of said longitudinal directions parallel to one another, with said prefabricated bottom centerline subassembly centered on said medial site and flanked by double-hulled ones of said midbody module hull subassemblies, with said pipe tunnel increment oriented inwards; and (f) respective ones of said subassemblies which adjoin one another girthwise of said midbody module, being secured along corresponding longitudinal extents thereof, to one another, and all of said subassemblies being secured to said transverse bulkhead, thereby uniting said subassemblies and said transverse bulkhead to provide said midbody module.

10. The midbody module of claim 9, wherein:

said box keel increment is at least as lineally extensive in a height direction of said midbody module, as are said double-hulled ones of said midbody hull subassemblies flanking said prefabricated bottom centerline subassembly, so that said pipe tunnel increment is disposed wholly within an inner hull collectively defined by said inner hull increments and said box keel.

11. The midbody module of claim 9, further including:

said transverse bulkhead comprising two laterally spaced complementary increments;

a longitudinal bulkhead which includes two laterally opposite wall increments secured in spaced, facially confronting relation with respective longitudinal directions aligned, by a plurality of longitudinally extending spacer plates, spaced from one another vertically of said midbody module, and connected along one lateral extent thereof to one of said wall increments and along an opposite lateral extent thereof to the other of said wall increments; and said longitudinal bulkhead being sandwiched between said increments of said transverse bulkhead and secured said increments of said transverse bulkhead to said longitudinal bulkhead, so that longitudinal bulkhead is incorporated into said midbody module.

12. The method of claim 11 wherein:

said longitudinal bulkhead is secured along a base thereof to an upper side of said pipe tunnel increment.

13. The method of claim 12, wherein:

said box keel increment is at least as lineally extensive in a height direction of said midbody module, as are said double-hulled ones of said midbody hull subassemblies flanking said prefabricated bottom centerline subassembly, so that said pipe tunnel increment is disposed wholly within an inner hull collectively defined by said inner hull increments and said box keel.

14. The midbody module of claim 9, wherein:

said outfitting equipment installed in said pipe tunnel further includes at least one of: instrumentation, hydraulic control piping, ventilation ducting and a walkway.

15. A longitudinal midbody for a double-hulled tanker, comprising a plurality of longitudinally aligned and serially interconnected modules, including:

a first midbody module having at least one cargo tank and at least one interhull space for receiving liquid ballast, comprising:

(a) shell including a box keel increment which is longitudinally coextensive with and connected along the length thereof to a pipe tunnel increment;

(b) outfitting equipment installed in said pipe tunnel increment, including valved longitudinal piping for serving at least one cargo tank and at least one interhull space, and thereby providing a prefabricated bottom centerline subassembly having a longitudinal direction;

(c) a transverse bulkhead having a perimeter including two opposed portions corresponding in location to vessel sidewalls, a first intervening portion corresponding in location to a vessel bottom, and a second intervening portion opposed to said first intervening portion and corresponding in location to a vessel deck, said first intervening portion having a medial site;

(d) a plurality of midbody module hull subassemblies, at least some of which are double-hulled, so as to include an outer hull increment having a longitudinal direction and an inner hull increment having a longitudinal direction and being secured in spaced, facially confronting relation to the respective said inner hull increment, with respective longitudinal directions aligned, by a plurality of longitudinally extending spacer plates, spaced from one another girthwise of said midbody module, and connected along an inner extent thereof to said inner hull increment and along an outer extent thereof to said outer hull increment;

(e) said midbody module hull subassemblies and said prefabricated bottom centerline subassembly being assembled about said perimeter of said transverse bulkhead with all of said longitudinal directions parallel to one another, with said prefabricated bottom centerline subassembly centered on said medial site and flanked by double-hulled ones of said midbody module hull subassemblies, with said pipe tunnel increment oriented inwards; and (f) respective ones of said subassemblies which adjoin one another girthwise of said midbody module, being secured along corresponding longitudinal extents thereof, to one another, and all of said subassemblies being secured to said transverse bulkhead, thereby uniting said subassemblies and said transverse bulkhead to provide said midbody module;

(g) a second and a third module each substantially identical in structure to said first midbody module;

(h) said second, first and third midbody modules being serially arranged, in horizontal, axially aligned orientation, end-to-end; and (i) respective adjacent portions of respective ones of said modules being connected to one another for thereby providing at least a multiple-module portion of said longitudinal midbody for a vessel, in which respective ends of respective pipes of said longitudinal piping are coupled to one another.

* * * * *